US006174387B1

(12) United States Patent
Bellows et al.

(10) Patent No.: US 6,174,387 B1
(45) Date of Patent: Jan. 16, 2001

(54) CREEP RESISTANT GAMMA TITANIUM ALUMINIDE ALLOY

(75) Inventors: Richard S. Bellows, Phoenix; Prabir R. Bhowal, Scottsdale; Howard F. Merrick, Phoenix, all of AZ (US)

(73) Assignee: AlliedSignal, Inc., Morris Township, NJ (US)

( * ) Notice: Under 35 U.S.C. 154(b), the term of this patent shall be extended for 0 days.

(21) Appl. No.: 09/153,430

(22) Filed: Sep. 14, 1998

Related U.S. Application Data

(60) Provisional application No. 60/058,872, filed on Sep. 15, 1997.

(51) Int. Cl.[7] ..... C22C 14/00
(52) U.S. Cl. ..... 148/421; 420/418
(58) Field of Search ..... 148/421; 420/418

(56) References Cited

U.S. PATENT DOCUMENTS

| | | | | |
|---|---|---|---|---|
| 3,008,823 | | 11/1961 | McAndrew . | |
| 4,923,534 | | 5/1990 | Huang et al. . | |
| 4,983,357 | | 1/1991 | Mitao et al. . | |
| 5,120,497 | | 6/1992 | Sayashi et al. . | |
| 5,226,985 | | 7/1993 | Kim et al. . | |
| 5,296,056 | | 3/1994 | Jain et al. . | |
| 5,350,466 | | 9/1994 | Larsen, Jr. et al. . | |
| 5,417,779 | * | 5/1995 | Griebel et al. | 148/421 |
| 5,417,781 | | 5/1995 | McQuay et al. . | |
| 5,431,754 | | 7/1995 | Fujiwara et al. . | |
| 5,558,729 | | 9/1996 | Kim et al. . | |
| 5,609,698 | | 3/1997 | Kelly et al. . | |
| 5,648,045 | * | 7/1997 | Masahashi et al. | 420/418 |

* cited by examiner

*Primary Examiner*—John Sheehan
(74) *Attorney, Agent, or Firm*—Robert Desmond, Esq.

(57) ABSTRACT

A creep resistant titianium aluminide alloy composition consisting essentially of, in atomic percent, about 44 to about 49 Al, about 0.5 to about 4.0 Nb, about 0.0 to about 3.0 Mn, about 1.0 to about 1.5 W, about 0.1 to about 1.0 Mo, about 0.4 to about 0.75 Si, and the balance Ti.

8 Claims, 2 Drawing Sheets

CREEP RESISTANT GAMMA TITANIUM ALUMINIDE ALLOY

CROSS REFERENCE TO RELATED APPLICATION

Priority is claimed to provisional application Ser. No. 60/058,872, filed Sep. 15, 1997.

TECHNICAL FIELD

This invention relates titanium aluminide alloys and in particular to a gamma titanium aluminide alloy having dramatically improved high temperature creep resistance and high temperature strength over currently available titanium aluminide alloys developed for aircraft use.

BACKGROUND OF THE INVENTION

The ongoing search for increased aircraft engine performance had prompted materials science engineers to investigate intermetallic compounds as replacement materials for nickel and cobalt base superalloys currently in widespread use in gas turbine engines. Of particular interest over the past decade has been gamma or near-gamma titanium aluminides because of their low density and relatively high modulus and strength at elevated temperatures.

Modifications have been made to the titanium aluminide composition in an attempt to improve the physical properties and processability of the material. For example, the ratio of titanium to aluminum has been adjusted and various alloying elements have been introduced in attempts to improve ductility, strength, and/or toughness. Moreover, various processing techniques, including thermomechanical treatments and heat treatments have been developed to this same end.

The latest alloy to be developed is disclosed in Larsen, Jr. et al., U.S. Pat. No. 5,350,466. Larsen et al. describe a titanium aluminide alloy composition consisting essentially of, in atomic percent, 44 to 49 Al, 0.5 to 4.0 Nb, 0.25 to 3.0 Mn, 0.1 to less than 1.0 W, 0.1 to less than 1.0 Mo, 0.1 to 0.6 Si, and the balance Ti. The alloy in U.S. Pat. No. 5,350,466 is superior to the other alloys in creep as claimed in the patent for the class of gamma titanium aluminides with reasonable room temperature ductility (e.g.,>0.5% elongation).

The present invention provides a titanium aluminide material alloyed with certain selected alloying elements in certain selected proportions that Applicants have discovered yields a further improvement in creep resistance than the alloy in U.S. Pat. No. 5,350,466, and additionally provides high temperature strength significantly exceeding the alloy of U.S. Pat. No. 5,350,466.

SUMMARY OF THE INVENTION

The present invention provides a creep resistant titianium aluminide alloy composition consisting essentially of, in atomic percent, about 44 to about 49 Al, about 0.5 to about 4.0 Nb, about 0.0 to about 3.0 Mn, about 1.0 to about 1.5 W, about 0.1 to about 1.0 Mo, about 0.4 to about 0.75 Si, and the balance Ti. A preferred titanium aluminide composition in accordance with the present invention consists essentially of, in atomic percent, 47 Al, 2.0 Nb, 0.0 Mn, 1.0 W, 0.5 Mo, 0.5 Si, and the balance Ti.

The aforementioned objects and advantages of the present invention will become more readily apparent from the following detailed description taken with the drawings.

DESCRIPTION OF THE PREFERRED EMBODIMENT

Figure 1:
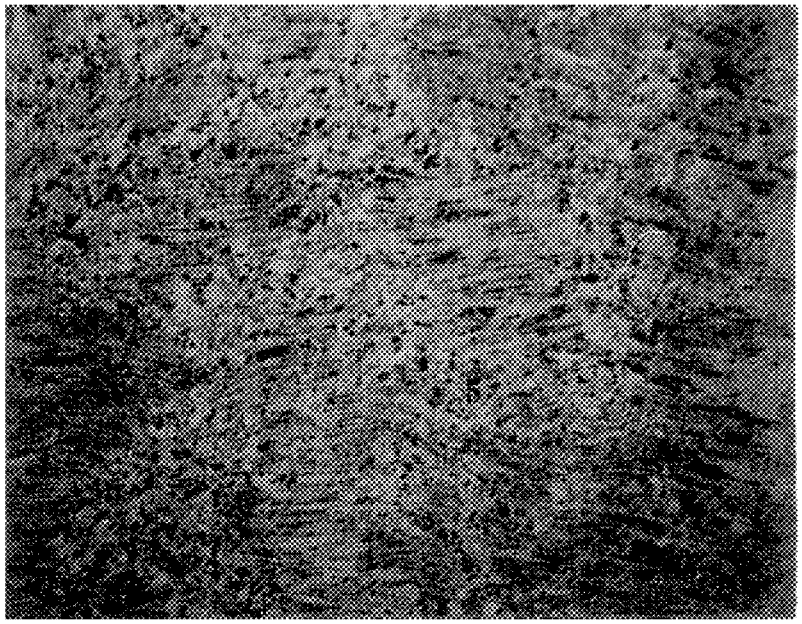
FIG. 1 is a photomicrograph at 100X magnification of the heat treated titanium aluminide alloy contemplated by the present invention.

Larsen, Jr. el al., U.S. Pat. No. 5,350,466 is hereby incorporated by reference.

The present invention provides a creep resist ant titianium aluminide alloy composition that in general exhibits greater creep resistance and improved high temperature strength than the titanium aluminide alloy taught by U.S. Pat. No. 5,350,466 and other previously developed titianium aluminide alloys in the heat treated condition, while maintaining acceptable room temperature ductility. The heat treated alloy of preferred composition set forth below exhibits creep resistance that is as much as an order of magnitude greater than previously developed titanium aluminide alloys.

The titanium aluminide composition in accordance with the present invention consists essentially of, in atomic percent, about 44 to about 49 Al, about 0.5 to about 4.0 Nb, about 0.0 to about 3.0 Mn, about 1.0 to about 1.5 W, about 0.1 to about 1.0 Mo, about 0.4 to about 0.75 Si, and the balance Ti. A preferred titanium aluminide composition in accordance with the present invention consists essentially of, in atomic percent, 47 Al, 2.0 Nb, 0.0 Mn, 1.0 W, 0.5 Mo, 0.5 Si, and the balance Ti.

The differences between the titanium aluminide alloy composition of the present invention and that disclosed in U.S. Pat. No. 5,350,466 are the extended use of tungsten (W) and silicon (Si) along with a reduction in manganese (Mn). The effect of these differences are shown in Table 1, which lists creep properties for the alloy disclosed in U.S. Pat. No. 5,350,466 (Row A), several experimental alloys produced in the investigation of the alloy composition for the present investigation (Row B) and for the alloy composition of the present invention (Row C). The creep values in the table for the experimental alloys were obtained from a Larson-Miller curve for these alloys. The creep values in the table for the present invention were the average of two values. For the present invention, the values at 1200 F and 1400 F were determined from the two 1200 F/40 ksi and two 1400 F/20 ksi tests by extrapolating the creep curves using the steady state creep rate exhibited in each corresponding test. This was necessary for the 1200 F and 1400 F values because of the extremely long duration of the creep test for the composition of the present invented alloy. Close inspection of the Table 1 shows the effect of Si and W in enhancing creep resistance significantly. The composition of the present invention (Row C) was established from a study of such effects. Table 1 clearly shows the dramatic improvement of the present invention (Row C) over U.S. Pat. No. 5,350,466 alloy (prior art, Row A).

TABLE 1

| Row | Alloy | Demonstration | Composition | Time in Hours to Reach 0.5% Creep | | |
|---|---|---|---|---|---|---|
| | | | | 1200 F./40 ksi | 1400 F./20 ksi | 1500 F./20 ksi |
| A | Larson | Previous baseline | Ti-47Al-2Nb-1Mn-0.5W-0.5Mo-0.2Si | 930 | 325 | 34 |
| | (Patent 5,350,466) | | Ti-47Al-2Nb-1Mn-0.5W-0.5Mo-0.1Si | 688 | 85 | 18 |
| B | Mod #4 | Increased Si | Ti-47Al-2Nb-1Mn-0.5W-0.5Mo-0.3Si | 1600 | 316 | 26 |
| | Mod #2 | Increased Si, decreased Mo | Ti-47Al-2Nb-1Mn-0.5W-0Mo-0.3Si | 1250 | 280 | 20 |
| | Mod #3 | Effect of increased W | Ti-47Al-2Nb-1Mn-1W-0Mo-0.3Si | 2050 | 960 | 65 |
| | Mod #5 | Further increase Si | Ti-47Al-2Nb-1Mn-0.5W-0.5Mo-0.5Si | 2640 | 690 | 45 |
| C | Current Alloy | Increased Si and W and reduced Mn | Ti-47Al-2Nb-0Mn-1W-0.5Mo-0.5Si | 14350* | 1935* | 131 |

Figure 3:
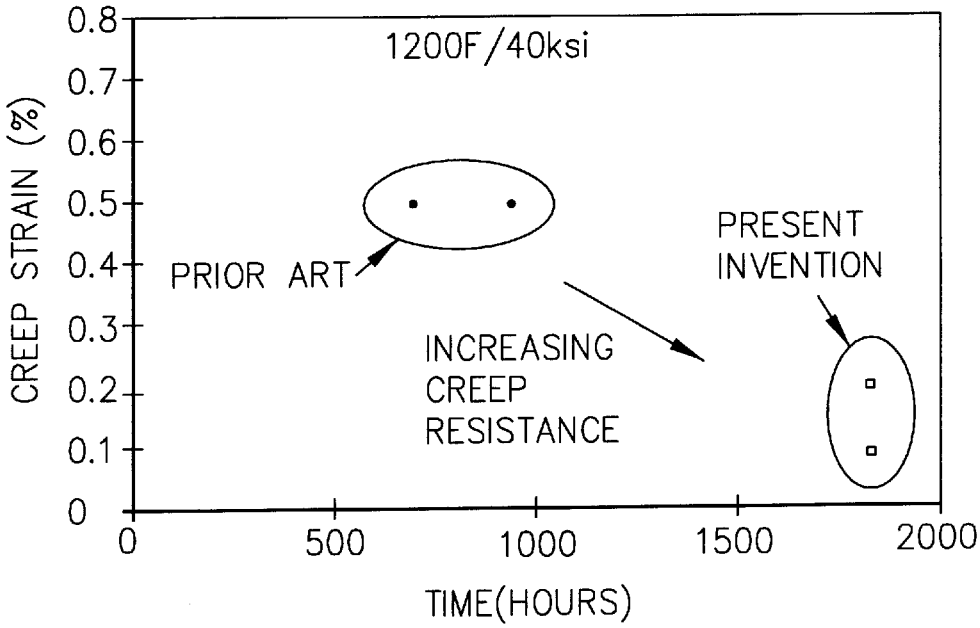
FIG. 3 shows the improvement in creep resistance at 1200 F and 40 ksi of the present invention over the prior art U.S. Pat. No. 5,350,466.
Figure 4:
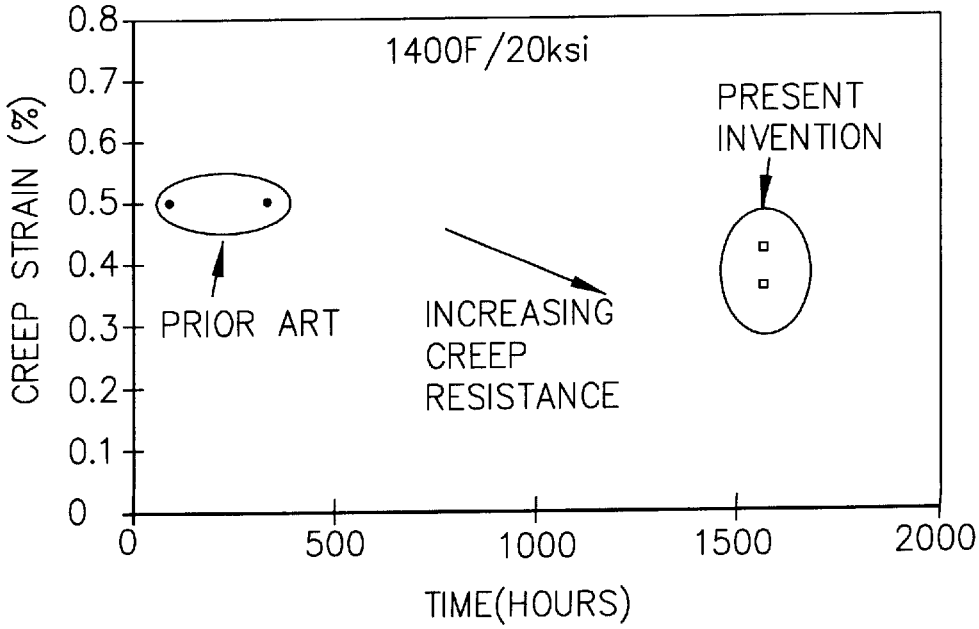
FIG. 4 shows the improvement in creep resistance at 1400 F and 20 ksi of the present invention over the prior art U.S. Pat. No. 5,350,466.

Alloys HIPed at 2300 F. and heat treated at 1850 F./50 hrs.
Mod alloy creep values obtained from Larson-Miller plots.
Current alloy creep values are average of two creep tests.
*Values averaged from extrapolated curves using steady state strain rates.

Where Table 1 compares the extrapolated 0.5% creep life for the present invention (because of the extremely long test times), it was considered instructive to display actual creep strain and life data at points where tests were terminated. FIGS. 3 and 4 are such plots for the two test conditions. For these figures, actual data (creep strain at the time of test interruption) from the 1200 F/40 ksi and 1400 F/20 ksi tests were used rather than extrapolated data and compared to the U.S. Pat. No. 5,350,466 alloy. A shift in data either to the left or downward or both represents an increase in creep resistance since it implies longer creep lives and/or lower creep strains. FIGS. 3 and 4 thus exemplifies the significant creep superiority of the present invention relative to prior art, and more specifically, the alloy of U.S. Pat. No. 5,350,466.

Both the ultimate tensile strength and yield strength of the present invention show improvement over the U.S. Pat. No. 5,350,466 alloy at 75 F and 1400 F while maintaining similar ductility values. The tensile strength data is shown in Table 2 for the present alloy and compared to the U.S. Pat. No. 5,350,466 alloy.

TABLE 2

| Alloy | Composition | 75 F. | | | 1400 F. | | |
|---|---|---|---|---|---|---|---|
| | | UTS (ksi) | YS (ksi) | EL (%) | UTS (ksi) | YS (ksi) | EL (%) |
| Larson (Patent 5,350,466) | Ti-47Al-2Nb-1Mn-0.5W-0.5Mo-0.2Si | 72.1 | 59.9 | 1.2 | 76.2 | 51.3 | 10.7 |
| | Ti-47Al-2Nb-1Mn-0.5W-0.5Mo-0.1Si | 68.8 | 56.7 | 1.3 | N.D. | N.D. | N.D. |
| Current Alloy | Ti-47Al-2Nb-0Mn-1W-0.5Mo-0.5Si | 81.25 | 73.5 | 0.8 | 86.5 | 62.25 | 8.0 |

Alloys HIPed at 2300 F. and heat treated at 1850 F./50 hrs.
Current alloy tensile values are average of two tensile tests.
N.D. -- Not Determined The titanium aluminide alloy of the invention can be melted and cast to ingot form in water cooled metal (e.g. Cu) ingot molds. The ingot may be worked to a wrought, shaped product. Alternately, the alloy can be melted and cast to net or near net shapes in ceramic investment molds or metal permanent molds. The alloy of the invention can be melted using conventional melting techniques, such as vacuum are melting and vacuum induction melting. The as-cast microstructure is described as lamellar containing laths of the gamma phase (TiAl) and alpha-two phase (Ti3Al).

Typically, the cast alloy is hot isostatically pressed to close internal casting defects (e.g. internal voids). In general, the as-cast alloy is hot isostatically pressed at 2100° –2400° F. at 10–25 ksi for 1–4 hours. A preferred hot isostatic press is conducted at a temperature of 2300° F. and argon pressure of 25 ksi for 4 hours.

The alloy can be heat treated to either a lame liar or duplex microstructure comprising predominantly gamma phase as equiaxed grains and lamellar colonies, a minor amount of alpha-two (Ti3Al) phase and additional uniformly distributed phases that contain W or Mo or Si, or combinations thereof with one another and/or with Ti.

The heat treatment is conducted at 1650° to 2400° F. for 1 to 50 hours. A preferred heat treatment comprises 1850° F. for 50 hours.

The following example is offered for purposes of illustrating, not limited, the scope of the invention.

EXAMPLE

Specimen bars of the present titanium aluminide alloy is listed in Tables I along with the Larsen alloy and several experimental alloys. The last-listed alloy (Ti-4 7Al-2Nb-0Mn-1W-0.5Mo-0.5Si) is representative of the present invention.

The present alloy was vacuum arc melted and then cast into an investment mold having a facecoat comprising yttria or zirconia. The alloy was solidified in the investment mold under vacuum in the casting apparatus and then air cooled to ambient. Cylindrical cast bars of ⅝ inch diameter and 8 inches length were thereby produced. The cast bars were hot isostatically pressed at 2300° F. and argon pressure of 25 ksi for 4 hours. Then, alloy specimens of the invention were heat treated at 1850° F. for 50 hours in an argon atmosphere and allowed to furnace cool to ambient.

Figure 2:
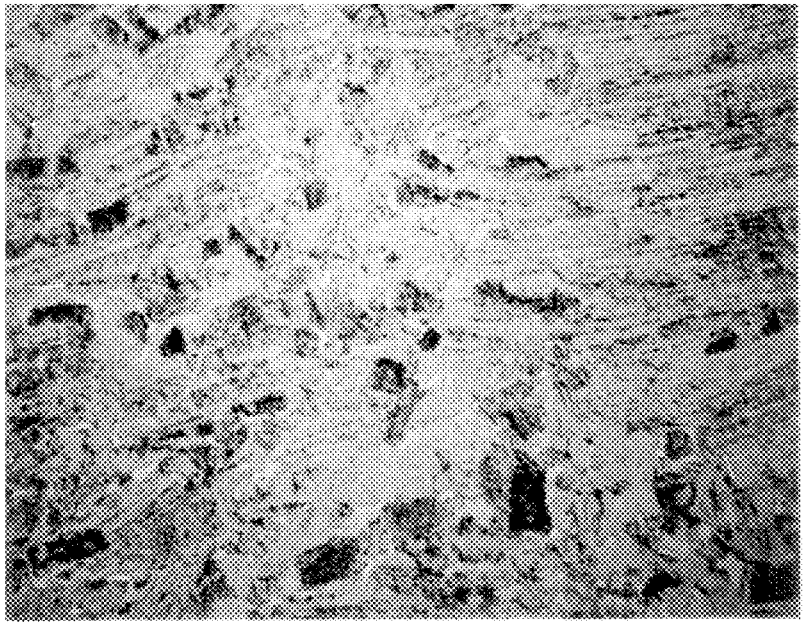
FIG. 2 is a photomicrograph at 500X magnification of the heat treated titanium aluminide alloy contemplated by the present invention.

The heat treated microstructure of the alloy of the invention (Ti47Al-2Nb-0Mn- 1W-0.5Mo-0.5Si) is shown in FIGS. 1 and 2 and comprises a lamellar structure containing laths of gamma phase and alpha-two phase. The heat treated microstructure of the Larsen alloy was similar. The heat treated microstructure comprises predominantly gamma (TiAl) phase and a minor amount (e.g. 5 volume %) alpha-two (Ti3Al) phase. Additional phases including W, Mo, or Si or combinations thereof with one another and/or with Ti are distributed as distinct regions intergranularly uniformly throughout the gamma and alpha-two phases.

Test specimens for creep testing and tensile testing were machined from the cast bars. The creep test specimens were machined and tested in accordance with ASTM test standard E139. The creep specimens were subjected to constant load creep testing at the elevated test temperatures and stresses set forth in Table I. The time to reach 0.5% creep strain was measured unless the test was interrupted prior to reaching 0.5% creep strain. If the test was interrupted then the steady state strain rate as established for the test prior to interruption was used to extrapolate the creep curve and determine the time to reach 0.5% creep strain. The average time to reach 0.5% creep strain typically for 2 specimens is set forth in Table I.

The tensile test specimens were machined and tested in accordance with ASTM test standard E8 and E21 at room temperature and at 1400° F. as set forth in Table II. The ultimate tensile strength (UTS), yield strength (YS), and elongation (EL) are set forth in Table II. The average UTS, YS, and EL typically for 2 specimens is set forth in Table II.

Referring to Tables I and II, it is apparent that the alloy of the invention (Ti-47Al-2Nb-0Mn-1W-0.5Mo-0.5Si) exhibited at 1200° F. an unexpected almost ten-fold improvement in creep resistance versus the Larsen titanium aluminide alloy. At 1400° F. and 1500° F., the creep resistance of the first-listed alloy of the invention was at least four-times that of the Larsen titanium aluminide alloy.

The room temperature tensile test data set forth in Table II indicate substantial improvement in the UTS (ultimate tensile strength) and YS (yield strength) of the alloy of the invention (Ti-47Al-2Nb-0Mn-1W-0.5Mo-0.5Si) versus the Larsen alloy.

The 1400° F. tensile test data set forth in Table II indicate that the UTS and YS of the alloy of the invention (Ti-47Al-2Nb-0Mn-1W-0.5Mo-0.5Si) are substantially improved relative to the Larsen alloy.

The aforementioned improvements in creep resistance and tensile properties are achieved in the first-listed alloy of the invention while providing a room temperature elongation of almost 1%, particularly 0.8%.

The dramatic improvement in creep resistance illustrated in Table I for the present invention may allow an increase in the maximum use temperature of titanium aluminide alloys in a gas turbine engine service from 1400° F. (provided by previously developed titanium aluminide alloys) to 1500° F. and possibly 1600° F. for the creep resistant alloy of the invention. The alloy of the invention thus could offer a 100°–200° F. improvement in gas turbine engine use temperature compared to the comparison titanium aluminide alloys. Moreover, since the titanium aluminide alloy of the invention has a substantially lower density than currently used nickel and cobalt base superalloys, the alloy of the invention has the potential to replace equiaxed nickel and cobalt base superalloy components in aircraft and industrial gas turbine engines.

Although the titanium aluminide alloy of the invention has been described in the Example hereabove as used in investment cast form, the alloy is amenable for use in wrought form as well. Modifications and variations of the present invention are possible in light of the above teachings. It is therefore to be understood that within the scope of the appended claims, the invention may be practiced otherwise than as specifically described herein.

Various modifications and alterations to the above-described preferred embodiment will be apparent to those skilled in the art. Accordingly, this description of the invention should be considered exemplary and not as limiting the scope and spirit of the invention as set forth in the following claims.

What is claimed is:

1. Titanium aluminide alloy composition consisting essentially of, in atomic %, about 44 to about 49 Al, about 0.5 to about 4.0 Nb, about 0.0 to about 3.0 Mn, about 1.0 to about 1.5 W, about 0.1 to about 1.0 Mo, about 0.4 to about 0.75 Si, and the balance Ti.

2. An investment casting having the composition of claim 1.

3. Titanium aluminide alloy composition consisting essentially of, in atomic %, about 47 Al, 2.0 Nb, 0.0 Mn, 1.0 W, 0.5 Mo, 0.5 Si, and the balance Ti.

4. An investment casting having the composition of claim 2.

5. A creep resistant titanium aluminide alloy article consisting essentially of, in atomic %, about 44 to about 49 Al, about 0.5 to about 4.0 Nb, about 0.0 to about 3.0 Mn, about 1.0 to about 1.5 W, about 0.1 to about 1.0 Mo, about 0.4 to about 0.75 Si, and the balance Ti, said article having a microstructure including gamma phase and at least one additional phase bearing at least one of W, Mo, and Si dispersed as distinct regions in the microstructure.

6. The article of claim 5 wherein the microstructure comprises a majority of gamma phase with a minority of alpha-two phase present.

7. The article of claim 5 wherein the additional phase is present as distinct regions located intergranularly of the gamma and alpha-two phases.

8. A creep resistant gas turbine engine component consisting essentially of, in atomic %, about 44 to about 49 Al, about 0.5 to about 4.0 Nb, about 0.0 to about 3.0 Mn, about 1.0 to about 1.5 W, about 0.1 to about 1.0 Mo, about 0.4 to about 0.75 Si, and the balance Ti, said article having a microstructure including gamma phase an at least one additional phase including W, Mo, or Si, or combinations thereof, dispersed as distinct regions in the microstructure.

* * * * *